US006550089B1

(12) United States Patent
Ussen

(10) Patent No.: US 6,550,089 B1
(45) Date of Patent: Apr. 22, 2003

(54) DEVICE FOR PICKING-UP SMALL-SIZED LITTER

(76) Inventor: Bakhytbek Z. Ussen, 81643 W. 8$^{th}$ Rd. PMB 47, Irrigon, OR (US) 97844-7036

( * ) Notice: Subject to any disclaimer, the term of this patent is extended or adjusted under 35 U.S.C. 154(b) by 153 days.

(21) Appl. No.: 09/685,865

(22) Filed: Oct. 11, 2000

(51) Int. Cl.$^{7}$ ..... D06F 39/00

(52) U.S. Cl. ..... 15/3; 15/49.1; 15/52.1; 15/52.2; 15/87; 15/79.2; 476/456; 476/222

(58) Field of Search ..... 15/49.1, 52.1, 15/52.2, 87, 79.2, 3; 446/456, 222

(56) References Cited

U.S. PATENT DOCUMENTS

| | | | | |
|---|---|---|---|---|
| 3,742,547 A | | 7/1973 | Sohmer | 15/104 |
| 4,209,942 A | | 7/1980 | Lohr | 446/443 |
| 4,438,588 A | | 3/1984 | Martin | 446/222 |
| 4,471,567 A | | 9/1984 | Martin | 446/437 |
| 4,480,401 A | | 11/1984 | Matsushiro | 446/456 |
| 4,541,814 A | | 9/1985 | Martin | 446/456 |
| 4,726,800 A | | 2/1988 | Kobayashi | 446/458 |
| 4,750,234 A | | 6/1988 | Quearry | 15/229 |
| 4,854,000 A | * | 8/1989 | Takimoto | 15/104.002 |
| 4,927,401 A | | 5/1990 | Sonesson | 446/456 |
| 5,334,076 A | | 8/1994 | Shinozuka | 446/456 |
| 5,363,534 A | | 11/1994 | Dekker | 15/339 |
| 5,507,058 A | * | 4/1996 | Minami et al. | 15/1.7 |
| 5,560,077 A | * | 10/1996 | Crotchett | 15/339 |
| 5,709,007 A | * | 1/1998 | Chiang | 16/48.5 |
| 5,776,215 A | | 7/1998 | Amoretti | 55/223 |
| 5,839,156 A | * | 11/1998 | Park et al. | 15/339 |
| 5,865,509 A | | 2/1999 | Monahan | 300/21 |
| 6,327,741 B1 | * | 12/2001 | Reed | 15/319 |

FOREIGN PATENT DOCUMENTS

| | | |
|---|---|---|
| RU | 2078530 | 5/1997 |
| RU | 2103903 | 2/1998 |
| SU | 560589 | 6/1977 |

* cited by examiner

*Primary Examiner*—Robert J. Warden, Sr.
*Assistant Examiner*—Shay L Balsis

(57) ABSTRACT

A device for picking-up small-sized litter from floor and other surfaces is generally disclosed comprising a remote-controlled electric motor with power supply (3) located inside a case (1) standing on supporting wheels (2), and attached rolling litter collector (5) with sticky, bristly, magnetic, or any other surface capable of collecting small-sized litter.

4 Claims, 5 Drawing Sheets

DEVICE FOR PICKING-UP SMALL-SIZED LITTER

CROSS-REFERENCE TO RELATED APPLICATIONS

Not applicable.

BACKGROUND—STATEMENT REGARDING FEDERALLY SPONSORED RESEARCH OR DEVELOPMENT

Not applicable.

REFERENCE TO MICROFICHE APPENDIX

Not applicable.

BACKGROUND

1. Field of Invention

This invention relates to home appliances, specifically to home appliances for cleaning of premises, and can also be used as a remote-controlled toy, allowing combination of teaching children to acquire skills of useful work and a game.

2. Description of Prior Art

Small-sized litter, like tiny pieces of paper, thread, oddments of an assembly material, small-sized parts of toys, and the like, generally resulting from children's activity, is often present on floor surface in children's rooms. Small-sized litter, including fallen down animal and human hair, may also be found in other parts of a house, e.g., living rooms, bedrooms, bathrooms and toilet rooms. Cleaning of floors from such small-sized litter is always a time consuming and often not a very pleasant activity.

Household appliances and devices used for cleaning of such litter normally include various brooms, sweepers, mops, vacuum cleaners and the like cumbersome household gears and appliances, which generally make it very difficult, if not impossible, to fully and effectively combine cleaning with another activity, like reading, writing, drawing, playing, working on a computer, watching TV, etc. A person using either of such appliances or devices is required to periodically move it from one place to another applying his manual force and move himself with the appliance or device and sometimes bend in the process of cleaning the surface. Doing so may be very difficult for elderly people and people having physical problems limiting them in movements, as well as for small children, it may also be boring enough for teenagers and not a fun for adults. All these represent major disadvantages of such known household cleaning appliances and devices, which are not capable of moving themselves without manual control of the user and application of his manual force.

Compact devices that are capable of moving themselves without such manual force of the user are known for many years and basically include radio-controlled toys, such as radio-controlled vehicles and radio-controlled balls. They are fun to use, however, their functions are generally limited to entertainment of children, and none of them are used for cleaning floor surfaces from small-sized litter.

Examples of prior cleaning devices are U.S. Pat. Nos. 3,742,547; 4,750,234; 5,363,534; 5,776,215; 5,865,509; RU Pat. Nos. 2078530; 2103903; and SU Pat. No. 560589. Examples of prior radio-controlled toys are U.S. Pat. Nos. 4,209,942; 4,438,588; 4,471,567; 4,480,401; 4,541,814; 4,726,800; 4,927,401; and 5,334,076.

SUMMARY OF INVENTION

In accordance with the present invention a device for picking-up small-sized litter from floor and other surfaces comprises a remote-controlled electric motor with a power supply located inside a case standing on supporting wheels, and attached rolling litter collector with a surface capable of collecting small-sized litter.

Objects and Advantages

Accordingly, several objects and advantages of the present invention are:

(a) to provide a cleaning device for various floor and other surfaces which does not require its user to manually move the device in the process of cleaning;

(b) to provide a cleaning device for various floor and other surfaces which does not require its user to bend in the process of cleaning;

(c) to provide a cleaning device for various floor and other surfaces which is convenient in use and simple in operation;

(d) to provide a cleaning device which will allow its user to combine the process of cleaning with other activities, like playing a game, watching a television program, reading, talking, etc.;

(e) to provide a cleaning device which will allow children to efficiently acquire skills of useful work while playing;

(f) to provide a cleaning device which will allow aged, sick and handicapped people to clean various floor and other surfaces from small-sized litter without a side help.

Further objects and advantages are to provide a cleaning device having the ready availability of various attachments allowing the single device to be suitable for different surfaces and types of litter, which is simple to use, easy to replace attachments and inexpensive to manufacture. Still further objects and advantages of my invention will become apparent from a consideration of the drawings and ensuing description.

DRAWING FIGURES

The accompanying drawings further describe the invention.

REFERENCE NUMERALS IN DRAWINGS

| | |
|---|---|
| 1 case | 2 wheels |
| 3 electric motor with power supply | 4 remote control |
| 5 litter collector | 6 levers |
| 7 longitudinal slots | 8 expansion for heads of levers |
| 9 hollow sphere | 10 cover |
| 11 reach-through holes | 12 antenna |

DESCRIPTION OF INVENTION

Figure 1:
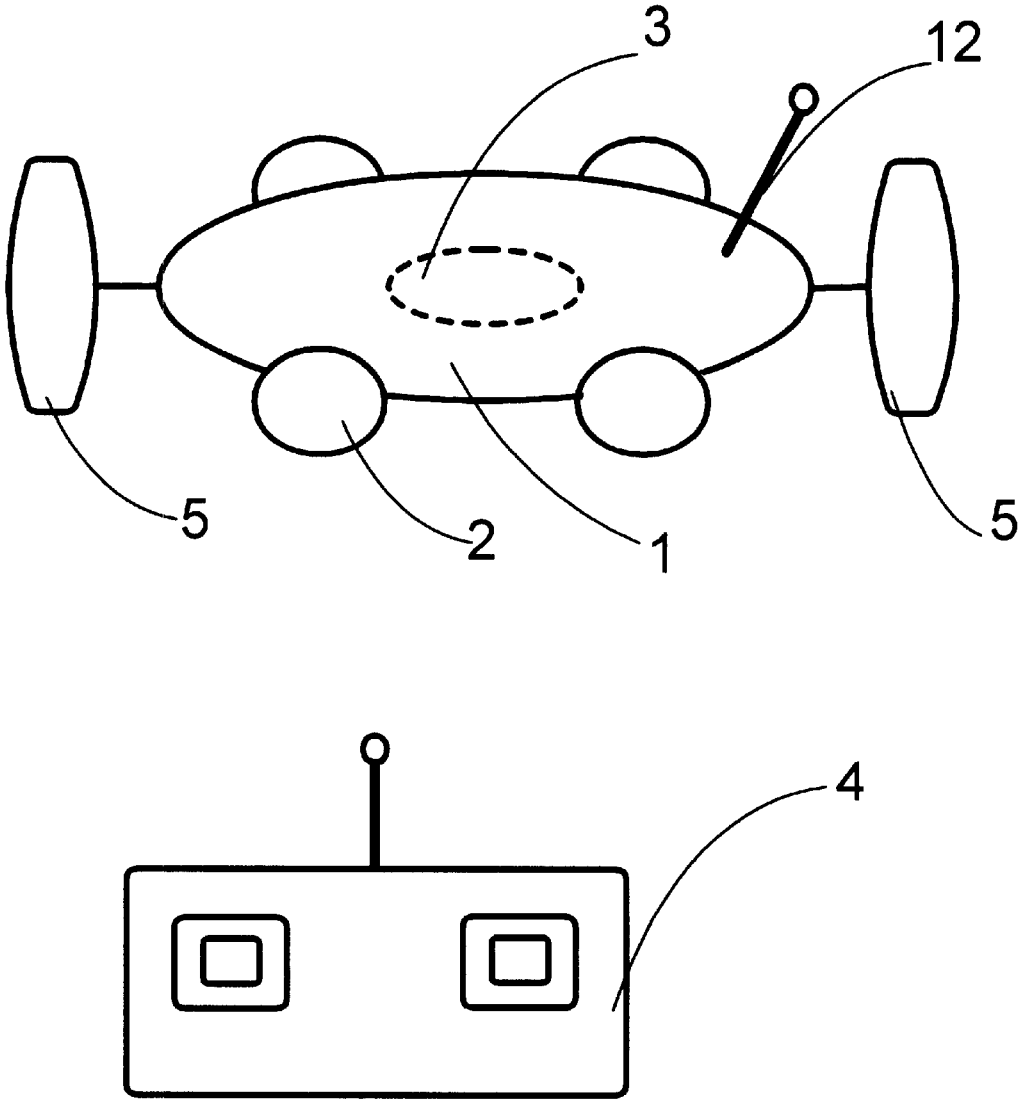
FIGS. 1 and 2 show various aspects of the device constructed in accordance with the invention.

FIG. 1—Preferred Embodiment

A preferred embodiment of the device of the present invention is illustrated in FIG. 1. The device has a case 1 standing on supporting wheels 2 and containing an electric motor with power supply 3, a remote control 4, a litter collector 5. In the preferred embodiment, the liter collector has a surface capable of collecting litter, said litter collector is being attached to said case with a possibility of rotation and movement in horizontal and vertical plane. In the preferred embodiment, a litter collector 5 is made as a roller with sticky, bristly, or magnetic surface, and is attached to the front or back of the case 1.

A device is operating as follows:

When an electric motor with power supply 3 is switched on (electric motor switches as a result of radio wave transmission from remote control 4 to antenna 12), the device starts its movement, and the roller 5 rotates picking-up small-sized litter from a floor or other horizontal surface on its way.

DESCRIPTION OF INVENTION

Figure 2:
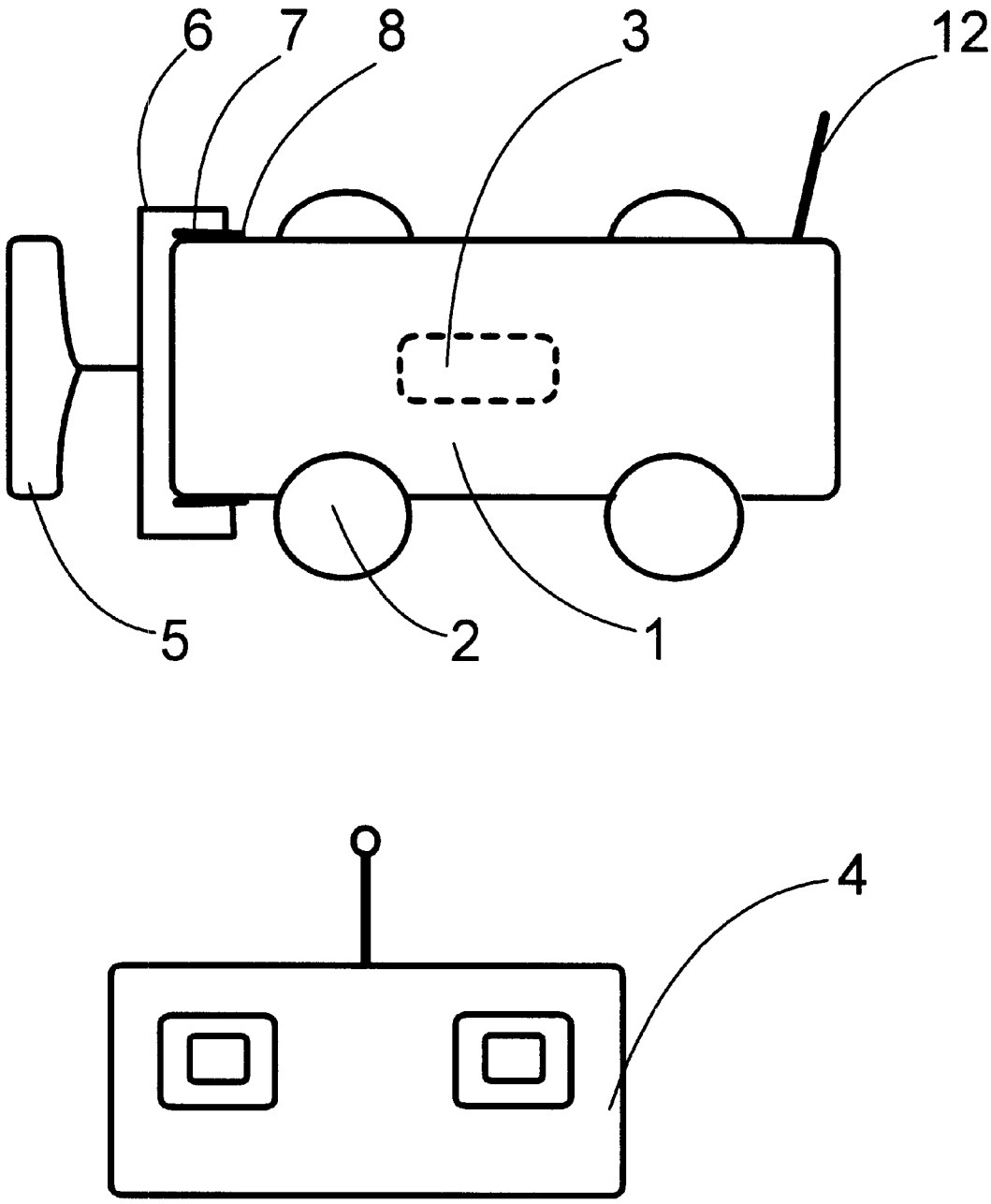

FIG. 2—Additional Embodiment

An additional embodiment is shown in FIG. 2, where a litter collector 5 is a roller with sticky, bristly, or magnetic surface, and is attached to the front or back of the case 1, and may be fixed with levers 6, located along a lateral surface of the case 1 in expansions for heads of levers 8 in longitudinal slots 7. Amount of collected small-sized litter being stuck to the surface of the roller 5 may increase over the time of operation of the device, thus complicating its movement. To prevent such complication, the roller 5 is attached to the case 1 by means of the levers 6 in expansion 8 of the slot 7, this allows changing position of the roller against the case in horizontal and vertical plane.

DESCRIPTION OF INVENTION

Figure 3A:
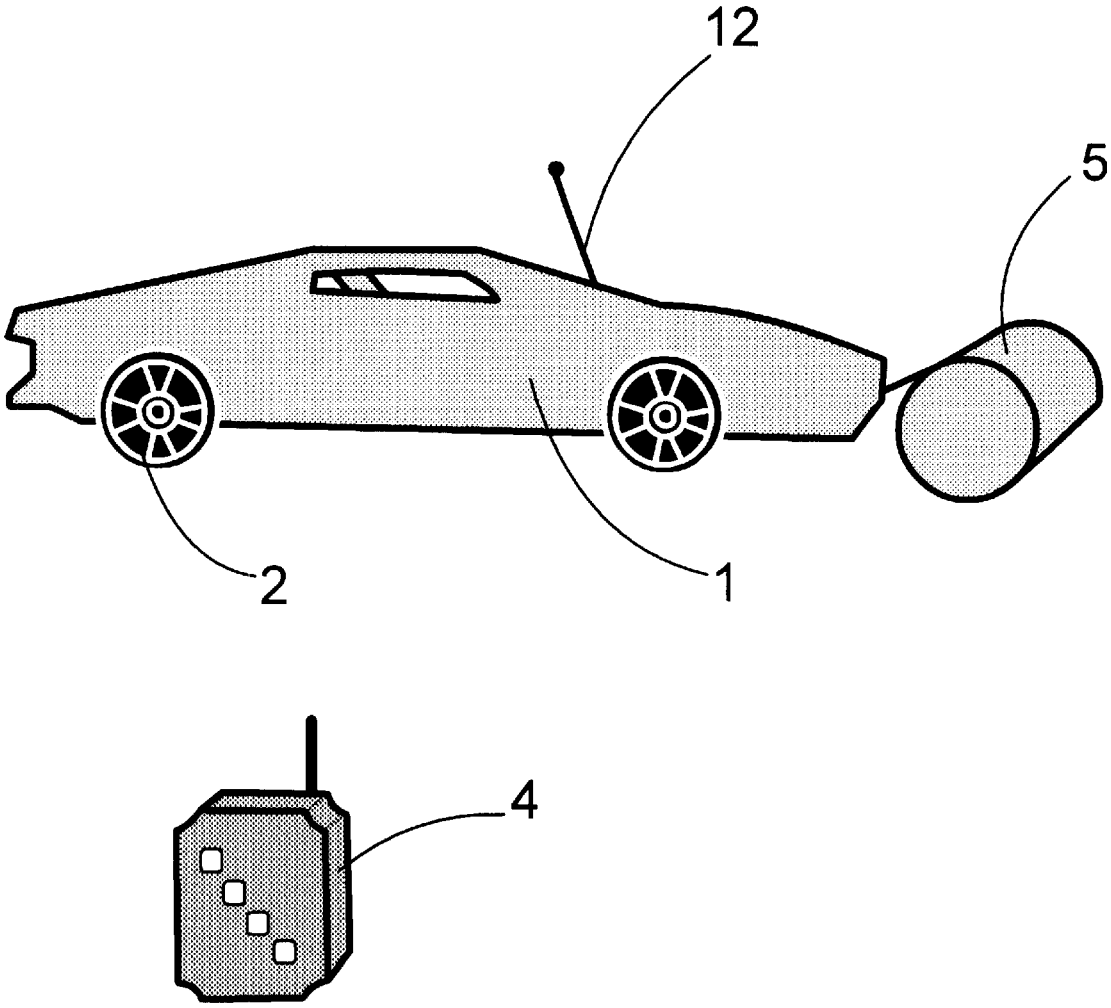
FIG. 3 shows the same device with a case made in the form of a toy vehicle and a litter collector made as a roller.
Figure 3B:
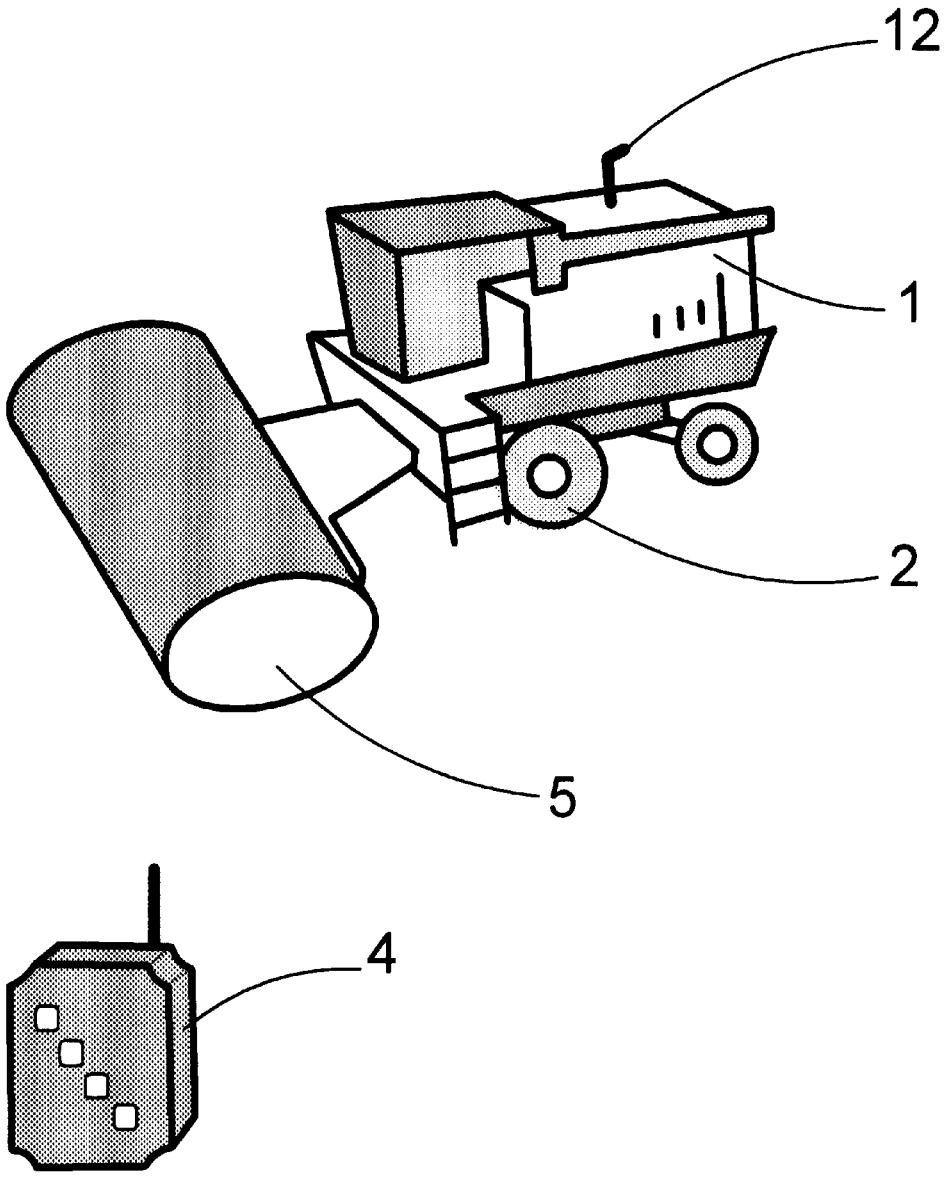
Figure 4:
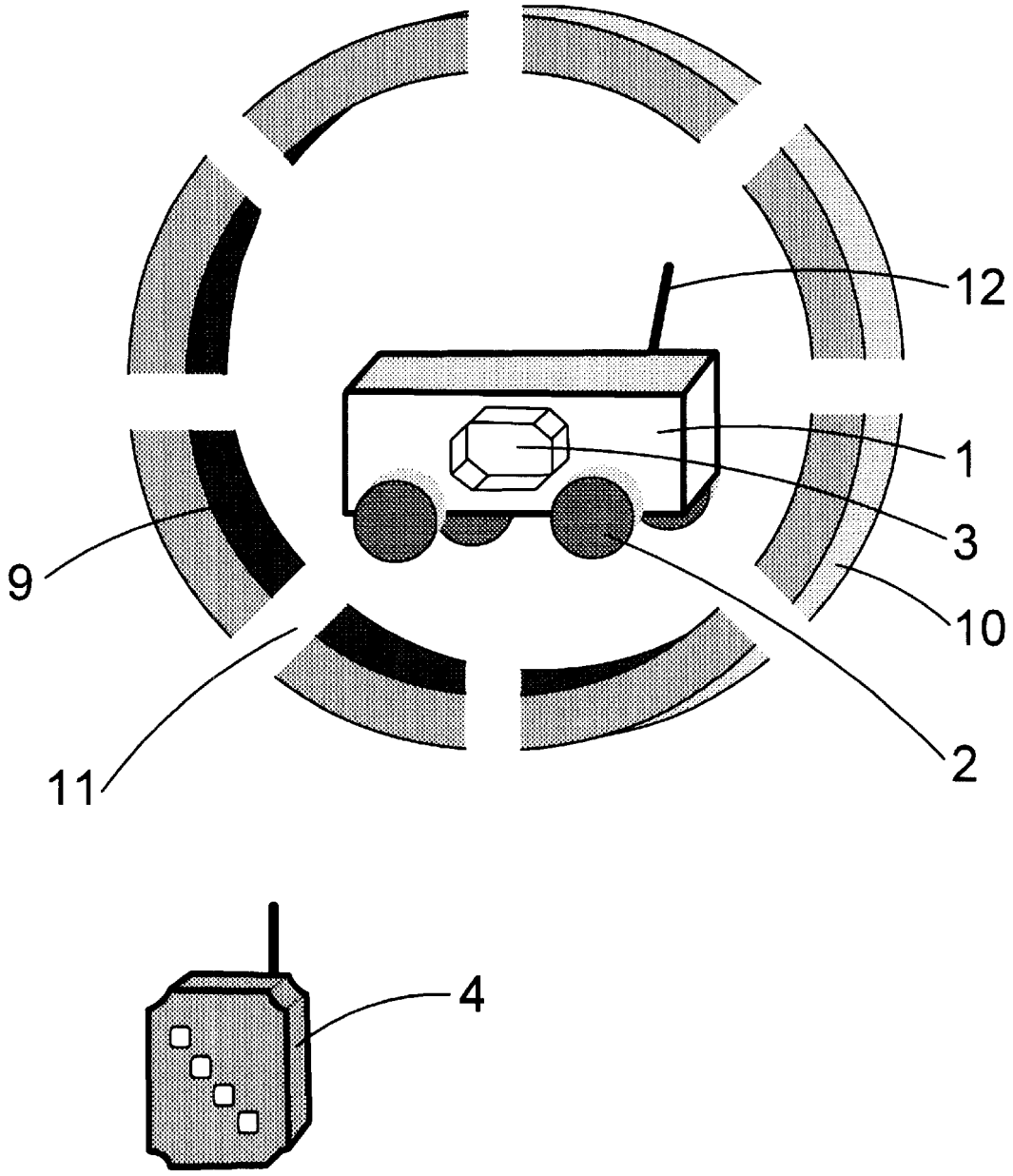
FIG. 4 shows the same device with a case disposed inside a hollow sphere and a litter collector made as a cover for the hollow sphere.

FIGS. 3 and 4—Alternative Embodiment

There are various possibilities with regard to the relative disposition of the case and the litter collector, as well as their shapes.

FIG. 3 shows the case made as a toy vehicle, and the litter collector made as a roller with sticky, bristly, or magnetic surface.

FIG. 4 shows the case disposed inside a hollow sphere 9, and the litter collector is a removable cover 10 made of an elastic material with sticky, bristly or magnetic surface, or as two elastic hemispheres. If illumination of the inner space of the sphere is desired to increase its attractiveness, a plurality of small reach-through holes 11 are to be made in each the cover and the sphere and illumination to be provided inside the sphere (e.g., bulbs of various colors).

Conclusion, Ramifications, and Scope

Accordingly, the reader will see that the cleaning device of this invention can be used to provide a simpler and more convenient in operation device for picking-up small-sized litter from floor and other surfaces. Furthermore, the device has the additional advantages in that

- it provides a device for cleaning various floor and other surfaces that does not require its user to manually move the device in the process of cleaning;
- it provides a device for cleaning various floor and other surfaces that does not require its user to bend in the process of cleaning;
- it provides a device for cleaning various floor and other surfaces which is convenient in use and simple in operation;
- it provides a device for cleaning various floor and other surfaces allowing its user to combine the process of cleaning with other activities, like playing a game, watching a television program, reading, talking, etc.;
- it provides a device for cleaning floors and other surfaces allowing children to efficiently acquire skills of useful work while playing;
- it provides a device for cleaning floors and other surfaces allowing aged, sick and handicapped people to clean various floor and other surfaces from small-sized litter without a side help;
- it provides a device for cleaning floors and other surfaces that is simple to use, easy to replace attachments and inexpensive to manufacture.

The above description and examples should be not construed as limitations on the scope of the invention. Many other variations are possible. Accordingly, the scope of the invention is determined by the claims and their legal equivalents.

What is claimed is:

1. A device for picking-up small-sized litter comprising a case, an electric motor with power supply, a remote control, a litter collector, and wheels, said electric motor with power supply disposed inside the case, said case attached to said wheels, said case-with remote control receiver, electric motor, power supply and wheels-disposed inside a hollow sphere, and said litter collector is an elastic cover of said hollow sphere, and said litter collector provided with a surface capable of collecting litter.

2. The device of claim 1, wherein said litter collector provided with sticky, bristly or magnetic surface.

3. The device of claim 1, wherein said elastic cover is made of two elastic hemispheres.

4. The device of claim 1, wherein said sphere and said elastic cover provided with a plurality of corresponding reach-through holes.

* * * * *